US012680443B2

(12) United States Patent
Lightfoot et al.

(10) Patent No.: US 12,680,443 B2
(45) Date of Patent: Jul. 14, 2026

(54) METHOD AND APPARATUS FOR DETERMINING OPTIMAL INSTALLATION OF DOWNHOLE EQUIPMENT

(71) Applicant: Oxy USA Inc., Houston, TX (US)

(72) Inventors: Jonathan Lightfoot, Spring, TX (US); Carlos Yicon, Richmond, TX (US); Austin Haggard, Houston, TX (US)

(73) Assignee: Oxy USA Inc., Houston, TX (US)

( * ) Notice: Subject to any disclaimer, the term of this patent is extended or adjusted under 35 U.S.C. 154(b) by 0 days.

(21) Appl. No.: 19/184,513

(22) Filed: Apr. 21, 2025

(65) Prior Publication Data

US 2025/0243749 A1 Jul. 31, 2025

Related U.S. Application Data

(63) Continuation of application No. 17/297,744, filed as application No. PCT/US2019/063733 on Nov. 27, 2019, now abandoned.

(60) Provisional application No. 62/772,388, filed on Nov. 28, 2018.

(51) Int. Cl.

| | |
|---|---|
| ***E21B 47/007*** | (2012.01) |
| ***E21B 41/00*** | (2006.01) |
| ***E21B 47/09*** | (2012.01) |

(52) U.S. Cl.

CPC ..... *E21B 47/007* (2020.05); *E21B 41/00* (2013.01); *E21B 47/09* (2013.01)

(58) Field of Classification Search

CPC ..... E21B 47/09; E21B 47/007

See application file for complete search history.

(56) References Cited

U.S. PATENT DOCUMENTS

| | | | | |
|---|---|---|---|---|
| 3,402,601 | A | 9/1968 | Heineman | |
| 6,779,598 | B2 * | 8/2004 | Hall | E21B 47/024 166/241.5 |
| 2003/0183397 | A1 | 10/2003 | Hoffman | |
| 2008/0170467 | A1 | 7/2008 | Barolak | |
| 2009/0071645 | A1 | 3/2009 | Kenison et al. | |
| 2009/0084546 | A1 * | 4/2009 | Ekseth | E21B 47/04 166/66 |
| 2012/0095686 | A1 | 4/2012 | Legendre et al. | |
| 2013/0076526 | A1 | 3/2013 | Schuberth et al. | |
| 2014/0174725 | A1 | 6/2014 | Dalvi et al. | |
| 2016/0245029 | A1 | 8/2016 | Andreychuk et al. | |
| 2016/0265905 | A1 | 9/2016 | Duncan et al. | |

(Continued)

FOREIGN PATENT DOCUMENTS

| | | | |
|---|---|---|---|
| CA | 3046456 | A1 | 8/2018 |
| WO | 2014184586 | A2 | 11/2014 |
| WO | 2018140322 | A1 | 8/2018 |

OTHER PUBLICATIONS

International Search Report and Written Opinion for corresponding application PCT/US2019/063733 dated Feb. 18, 2020 (16 pp).

(Continued)

*Primary Examiner* — Tara Schimpf
*Assistant Examiner* — Lamia Quaim
(74) *Attorney, Agent, or Firm* — Renner, Kenner; Arthur M. Reginelli

(57) ABSTRACT

A method for mapping a cased wellbore, the method comprising providing a cased wellbore; and routing a sensor assembly through said cased wellbore to measure forces applied to said sensor assembly.

10 Claims, 4 Drawing Sheets

(56) References Cited

U.S. PATENT DOCUMENTS

| | | | |
|---|---|---|---|
| 2017/0131433 | A1 | 5/2017 | Hartmann et al. |
| 2018/0023384 | A1 | 1/2018 | Girrell et al. |
| 2018/0156936 | A1 | 6/2018 | Zhang |

OTHER PUBLICATIONS

European Office Action for the corresponding European Patent Application No. 19828385.5 dated Oct. 11, 2023 (5 pp).

* cited by examiner

METHOD AND APPARATUS FOR DETERMINING OPTIMAL INSTALLATION OF DOWNHOLE EQUIPMENT

This application is a continuation application of U.S. application Ser. No. 17/297,744 filed on May 27, 2021, which is a national-stage application of PCT/US2019/063733 filed on Nov. 27, 2019, which claims the benefit of U.S. provisional application No. 62/772,388 filed on Nov. 28, 2018, and are incorporated herein by reference.

FIELD OF THE INVENTION

Generally, the present invention is directed to the mapping of cased wells. Specifically, the present invention is directed to the use of a strain gauge to map a cased well so as to determine optimal installation positions of downhole equipment such as artificial lift equipment.

BACKGROUND OF THE INVENTION

Significant improvements in oil and gas production have been provided by the use of hydraulic fracturing and horizontal drilling technologies. Further improvements have been realized with advances in data collection and analysis of that data.

One area of known excessive cost in oil and gas production is the use and maintenance of equipment in operating a well. Current wells are drilled with techniques such that a wellbore path can be established with a fair amount of accuracy. This is done with sensor devices either associated with bottom-hole assembly (BHA) during drilling and/or sensors selectively used during the wellbore drilling process. The BHA sensors collect data regarding the wellbore path, the geology that defines the wellbore, and other characteristics associated with the wellbore.

After an initial wellbore is formed and prior to extracting the hydrocarbons, modifications may be made to the wellbore to facilitate the extraction process. One modification is to line selected sections of the wellbore with a casing typically constructed with lengths of metal pipe. Where appropriate, cement may be used to support and seal selected sections of the metal pipes to maintain the integrity of the casing and prevent contaminant migration. Casings ensure that the extracted material does not contaminate environmentally sensitive strata such as water tables and the like. Casings may also be used to support downhole equipment maintained in the wellbore that facilitate the extraction process.

The wellbore is often mapped and logged for directional changes and the path of the casing generally matches the wellbore. However, reliance solely on a directional wellbore positioning map for the path of the casing is problematic. An accurate map of the wellbore is helpful when installing artificial lift equipment. The artificial lift equipment is needed in wells when there is insufficient pressure in the reservoir to lift the produced fluids to the surface. Therefore, the main goal of the artificial lift equipment is to lower production bottom-hole pressure (BHP) on the formation to obtain a high production rate form the well. Most oil wells require artificial lift at some point in the life of the field. Common artificial lift equipment includes: electrical submersible pumps (ESPs), which include a series of centrifugal submersible pumps that rotate by electrical downhole motors; progressive cavity pumps (PCPs); which are positive displacement pumps that use an eccentrically rotating single-helical rotor turning inside a stator, which are turned by downhole or surface motors; rod pumps, which are long slender rod and cylinders with both fixed and moveable elements inside; gas lift methods, which use an external source of high-pressure gas for supplementing formation gas to lift the well fluids and operate on the principle that gas injected into the tubing reduces the density of the fluids in the tubing; and plunger lift, which utilizes a free piston that travels up and down the wells tubing string without obstruction.

It is important to ensure maximum run life on the artificial lift equipment in order to reduce the operational cost. For example, the minimum desired run life for an ESP unit is one year; however, on occasion the equipment fails in a matter of days from installation. Failure of an ESP or any other component maintained within the casing is very expensive. These excessive costs are related to the replacement equipment, the reinstallation costs, and the loss of production during reinstallation.

One solution to this problem is to utilize high-accuracy, short-interval gyroscopes to determine the mapping or path of existing cased wells. However, these gyroscopes may not be able to measure short enough incremental distances for accurate placement of equipment. More importantly, although gyroscopes are good at measuring a change in azimuth and inclination of a casing as a predictor of force that would be exerted by the casing on installed equipment, the gyroscopes are unable to provide actual direct data measurements about casing sections that may have been pinched, bulged, spiraled, or exhibit any other type of deformation. As such, the problem with properly placing the equipment in the casing still exists.

Based upon the foregoing, there is a need in the art for a way to directly measure cased hole deviations.

SUMMARY OF THE INVENTION

One or more embodiments of the present invention provide a method for mapping a cased wellbore, the method comprising providing a cased wellbore; and routing a sensor assembly through said cased wellbore to measure forces applied to said sensor assembly.

Other embodiments of the present invention provide a method for installing downhole production equipment within a cased well, the method comprising (i) drilling a wellbore and installing casing in said wellbore; (ii) configuring a sensor assembly to represent a piece of downhole equipment to be installed in said casing; (iii) routing said sensor assembly through said casing while measuring forces exerted on said sensor assembly; and (iv) determining a location within said casing, based upon said measurement forces, where the installation of downhole equipment will be desirable; and installing downhole equipment in said location.

Still other embodiments of the present invention provide a method for determining where to locate downhole equipment in a cased wellbore, comprising (i) providing a sensor assembly adapted to traverse a cased wellbore; (ii) measuring a plurality of forces exerted on said sensor assembly during traversal thereof through said cased wellbore; and (iii) determining from said plurality of forces optimal locations for positioning of downhole equipment.

Yet other embodiments of the present invention provide a system for determining optimal locations for installation of downhole equipment in a cased wellbore, the system comprising (i) a conveyance system associated with a cased wellbore; (ii) a sensor assembly coupled to said conveyance system that conveys said sensor assembly within the cased wellbore, said sensor assembly measuring forces exerted by the cased wellbore during travel therethrough; and (iii) a controller adapted to communicate with said sensor assembly and said conveyance system so as to correlate measured forces with a position of the sensor assembly in the cased wellbore.

DETAILED DESCRIPTION OF ILLUSTRATIVE EMBODIMENTS

Embodiments of the invention are based, at least in part, on the discovery of a method and associated for system for mapping cased wells by using a strain-gauge sensor. It has been discovered that casing strings can deviate differently than the wellbore in which they are installed, and therefore information relative to deviations in the casing string, which is also referred to as cased hole tortuosity, is valuable to the configuration and operation of the well. The methodologies of the present invention offer a way to directly determine cased hole characteristics and mapping, which offer several advantages, including greater accuracy, over other contemplated methodologies. In particular embodiments of the invention, the information obtained by mapping the cased wellbore can be used to determine a desired location for placing downhole production equipment such as downhole lift devices.

Figure 1:
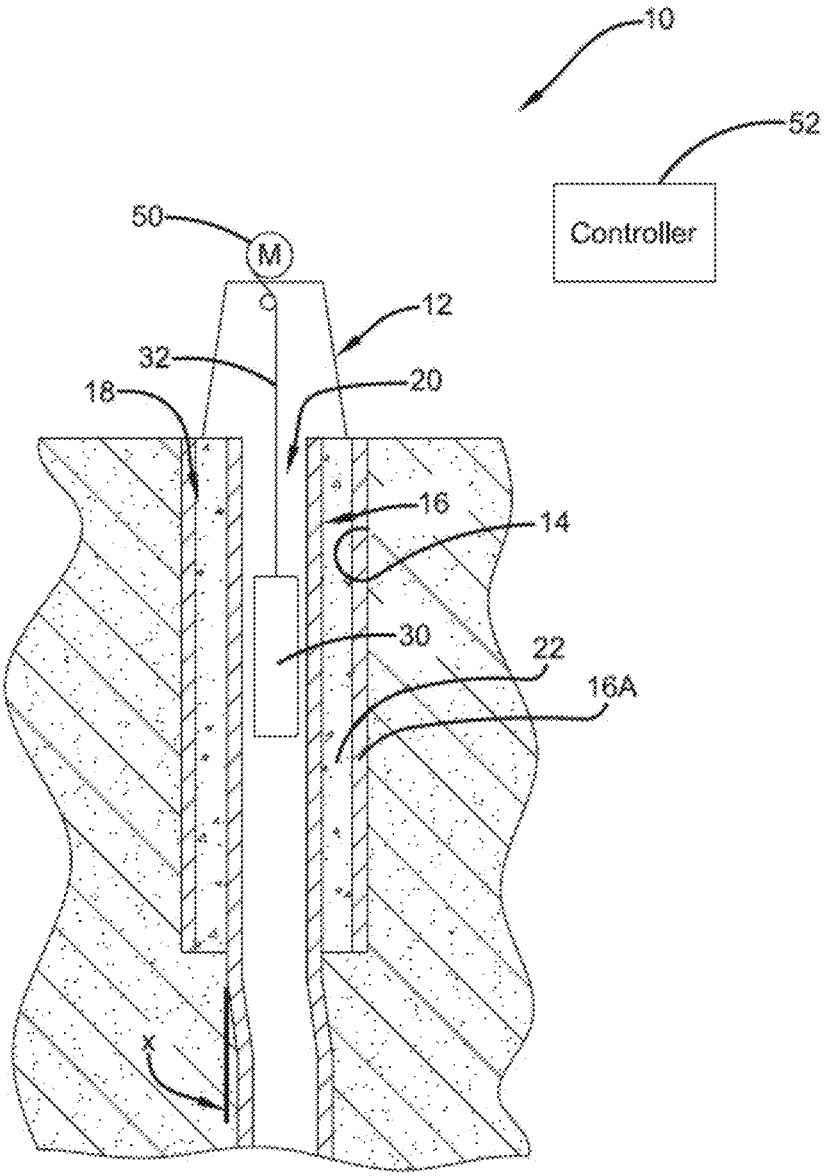
FIG. 1 is a schematic representation of a cased wellbore according to the concepts of the present invention.

Aspects of the invention can be described with reference to FIG. 1, which shows system 10 including wellbore support structure 12, wellbore 14, and casing string 16. Support structure 12 is aligned relative to wellbore 14 so that wellbore 14 can receive various elements supported by support structure 12 such as drilling rods and associated drilling equipment. Casing 16 is disposed within wellbore 14 and typically extends from the surface through the entire length, or substantially the entire length, of the wellbore. An annulus 18 is disposed between casing string 16 and wellbore 14. Casing string 16 is typically secured in place with a cement 22, which is disposed within annulus 18. Disposed within casing string 16 is a cylindrical opening 20, which may be referred to as cased hole 20.

Support structure 12, which may also be referred to as derrick 12, is a support structure that can support or otherwise carry structural rigging and other mechanical, electrical, and hydraulic equipment that may needed to undertake various tasks relative to the construction and/or operation of a well, such as drilling. After the drilling operation, the drilling equipment is removed to allow for the manipulation of other equipment, such casings and its associated structural features, to be installed in the well, as well as other extraction equipment utilized to extract hydrocarbons, such as lift equipment.

As the skilled person understands, casing string 16 includes a plurality of pipes, which are also referred to as casings, interconnected by coupling elements. The individual casing are typically about 40 feet in length and can vary in diameter, depending upon the type of well, and the location within the well, the individual casing. Generally speaking, wellbores typically have a diameter of from between 4" to 50", and the casings have a correspondingly reduced diameter. In some embodiments, the casing outer diameter may range from 5" to 9½" or larger. As the skilled person appreciates, the inner diameter of the casing can be a significant factor in determining the outer diameter size of the downhole equipment that is installed within the well, and the outer diameter of the downhole equipment is sized to provide the maximum extraction capability. Additionally, although the wellbore 14 and the casing 16 are shown in a substantially vertical orientation, skilled artisans will appreciate that the wellbore and casing may be in any orientation used for the extraction of resources (e.g. horizontal). In any event, it is desirable to install downhole equipment that operates efficiently without failure, as discussed above.

From a functional standpoint, the casing string is typically employed to protect the wellbore and prevent fluids or other contaminants from migrating into the geographical strata surrounding the wellbore or vice versa, maintain wellbore stability, prevent contamination of water sands, isolate water from producing formations, and control well pressures during drilling, production, and workover operations. Casing can also provide locations for the installation of blowout preventers, wellhead equipment, pumps, lifts, and other downhole equipment, as well production packers and production tubing.

Figure 2:
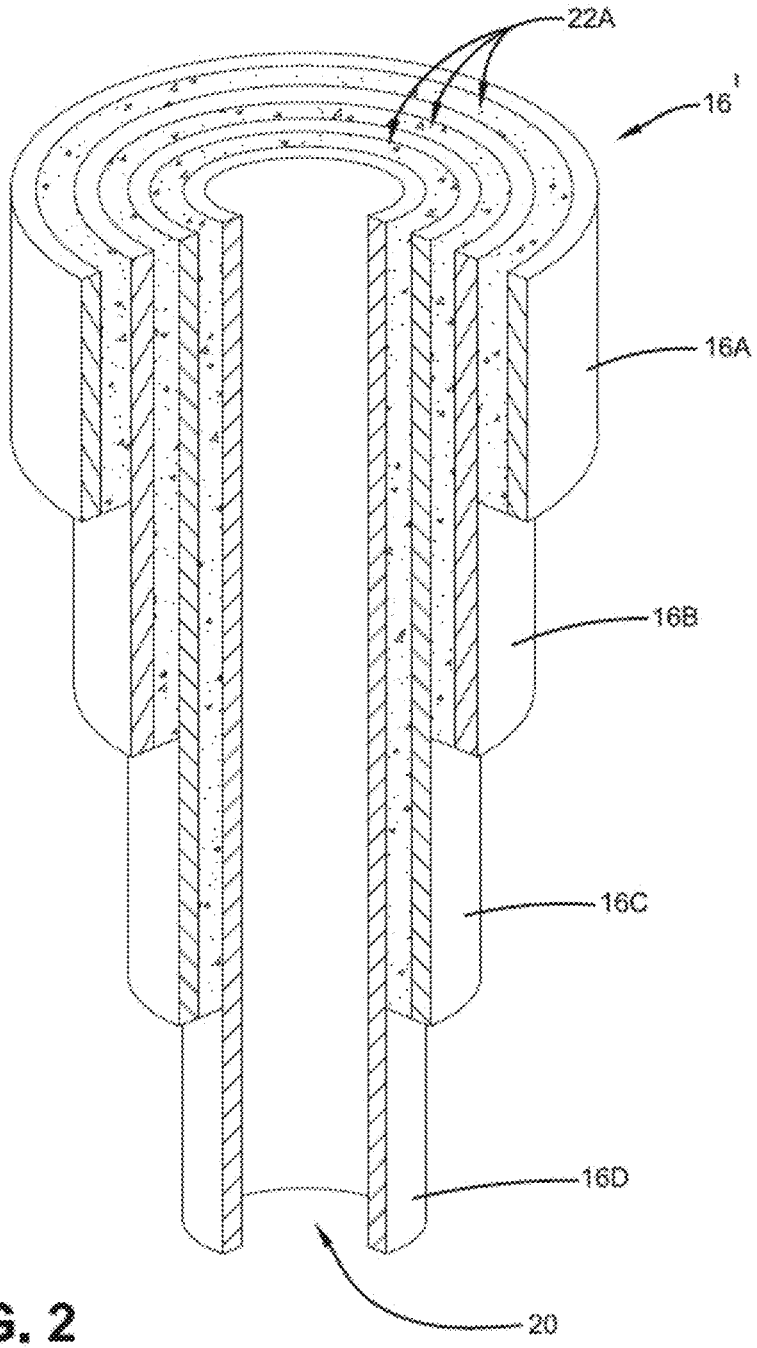
FIG. 2 is a partial cut-away perspective view of exemplary casing used with the well system.

Wells often include a plurality of different types of casing and/or casing strings, which collectively form an overall casing system. An exemplary casing system can be described with respect to FIG. 2, which shows casing system 16', which includes several concentric sub-casings (which may include concentric sub-casing strings). As shown, casing system 16' may include a conductor casing 16A, which is the outermost casing string and which supports one or more additional casing strings disposed within string 16A. For example, a diametrically smaller casing 16B may be positioned within casing 16A, and in a similar manner, a smaller diameter intermediate casing 16C can be positioned within casing 16B. And, a diametrically smaller production casing 16D can be positioned within intermediate casing 16C. Each casing string of the casing system may be of a different length as required by the well design. Cement 22 may be disposed between each of the concentric strings, and the cement disposed between any two casing strings may run the entire length of the shorter of two adjacent strings, or the cement may be disposed for only a portion of the length between two adjacent strings. It will be appreciated that the concentric casing may be used at different depths of the well depending on the surrounding geology. Although not shown, liners, which do not extend to the surface of the well, may be positioned within casings. These liners may provide continuity between adjacent axially positioned casings.

The drilling of the wellbore and the installation of the casings (including the cementing of the casings) can take place by using conventional techniques, which are well known in the art. For example, it is often typical practice to drill a section of the wellbore (i.e. drill to a desired depth), and then line the wellbore with appropriate casings. After this step, additional drilling may take place below the location where the casing is installed to lengthen the wellbore, and then additional casing is installed within this newly drilled section. Typically, the casing that is installed following this additional or subsequent drilling step is narrower in diameter than the previously installed casing string, which results in the configuration or system shown in FIG. 2. These steps can be repeated as required by the well design until the final casing is installed, which is typically the production casing.

After installation of the casing, which may include cementing of the casings, the casing string is mapped pursuant to practice of this invention. It will be appreciated that the mapping of the innermost casing string, which could include a liner where a liner is present, is the target for the mapping, despite the presence of a plurality of concentric casings (i.e. a casing system 16'). For example, the target of the mapping process of the present invention may include mapping of the production casing. It will also be appreciated that the mapping of the casing will take place prior to installation of any production tubing or production equipment such as lift equipment.

As indicated above, the goal of mapping the casing is to determine the overall tortuosity of the casing; for example, mapping the casing serves to identify any deviations in the casing string, which deviations may include directional deviations, deviations in the diameter of the casing at any given point along the length of the casing, changes in orientation, and/or combination of distortions and changes in orientation. It will be appreciated that these deviations can result from deviations in the wellbore or result from installation of the casing. For example, forces applied to the casing during installation or changes in nearby geology can pinch, collapse, spiral, helically distort, bend, bulge, undulate or otherwise deform a portion of the casing string. With reference again to FIG. 1, a deviation is shown where a portion of casing 16 is inclined or slightly offset at a distance "x."

In one or more embodiments, the mapping step, which may also be referred to as logging step, takes place by routing, which may also be referred to as conveying, a sensor device, which may also be referred to as a sensor assembly, through the casing. With reference to FIG. 1, a sensor assembly 30 is shown positioned within cased hole 20. Sensor assembly 30 may be connected to a conveyance system 50 via a cable 32. As used herein, a conveyance system generally refers to any system that is adapted to convey sensor assembly 30 through the casing 16. Also, several other conveyance or attachments elements can be used in lieu or in addition to cable 21. For example, sensor 30 can be connected to conveyance system 50 via jointed pipe, a wireline, a single-strand slickline, a multi-strand braided wire, an electric wireline, coil tubing, a solid pipe, a continuous solid rod, or any other conveyance elements known in the art. Other embodiments may employ a sensor assembly that is capable of operating autonomously within the casing without a physical connection to a conveyance system.

A controller 52 may be in communication with conveyance system 50 for the purpose of controlling the routing and retrieval of assembly 30. Additionally, the same or a different controller or data collection and/or processing unit can be communication with assembly 30 to receive the data collected from assembly 30. For example, controller 52 may provide the necessary hardware, software, memory, and related components that are adapted for transferring the data or directly analyzing the data collected so as to determine deviations within casing 16.

In particular embodiments, sensor assembly 30 is routed through cased hole 20 by gravity feeding the assembly 30 into cased hole 20. This step of conveying can be assisted by the use of weights (not shown) attached to or otherwise acting on sensor assembly 30 or conveying element 32, which may help propel sensor assembly 30 through casing 16. In some embodiments, a tractor mechanism may also be employed to push or pull sensor assembly 30 through casing 16. It will also be appreciated that conveyance system 50, with assistance of attachment elements 32, can assist in retrieving assembly 30 after it has completed its path through cased hole 20.

In one or more embodiments, conveyance system 34 may include or incorporate communication wires so as to transmit data collected from sensor assembly 30. Skilled artisans will also appreciate that the data may be stored internally in sensor assembly 30 and retrieved at a later time for analysis, or the data may be transmitted directly from sensor assembly 30 utilizing wired, wireless, or other types of data signals.

Figure 4:
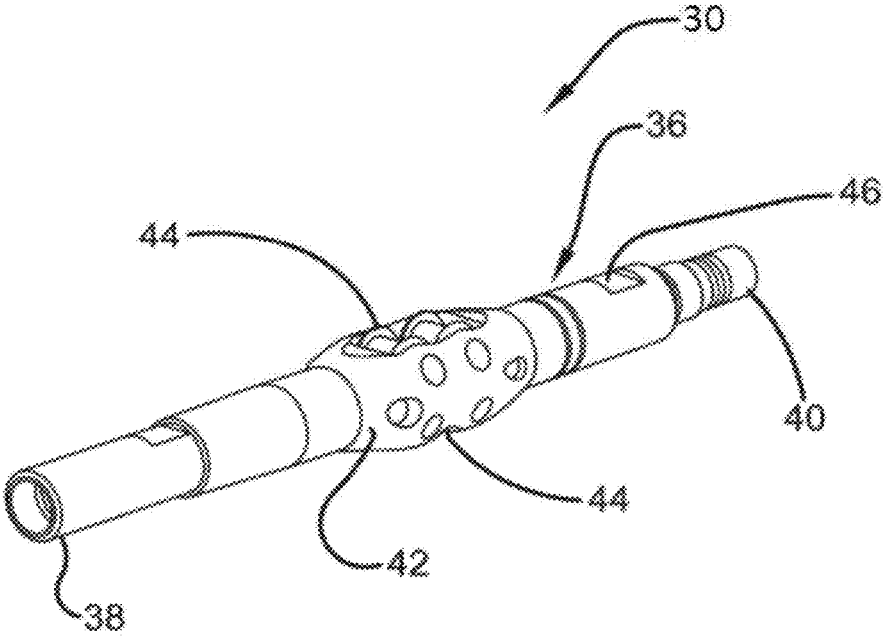
FIG. 4 is a schematic representation of a portion of a cased wellbore according to the concepts of the present invention.

In accord with the present invention, sensor assembly 30 includes one or more strain gauge sensors, or any other type of measurable force sensor, that can measure strain placed upon one or more elements of assembly 30. An exemplary assembly 30 can be described with reference to FIG. 4. Generally speaking, assembly 30 includes a body 36, a lead end 38, a trailing end 40, a carriage 42, wheels 44, and a strain-gauge sensor 46. As will be appreciated, lead end 38 can be designed to be first inserted into cased hole 20 with trailing end 40 directly or indirectly connected to the conveyance system 50. Carriage 42 can be adapted to swivel 360° about the axial length of body 36, and carriage 42 can carry any number of wheels 44. Together, swivel carriage 42 and wheels 44 may facilitate the traversal of sensor assembly 30 through casing 16. In one or more embodiments, swivel carriage 42 and wheels 44 may provide the point of contact with the casing string and sensor 46 measures strain imparted thereon.

In one or more embodiments, assembly 30 is sized or is otherwise configured to be insertable into the casing 16. For example, one or more elements of assembly 30 are designed and/or shaped to represent the general geometry of downhole equipment that is envisaged for the well. In other words, one or more elements of assembly 30 are configured to experience the same or similar forces that will be experienced by downhole equipment that will be subsequently installed within the well. For example, housing 36 can be sized to have mechanical properties such as an outer diameter and length and/or stiffness or flexibility that matches or otherwise approximates the proposed equipment to be installed. Or, either alone or in conjunction with the body, the wheels can be sized or positioned to represent or otherwise mimic a feature of the anticipated downhole equipment such as the diameter of the anticipated downhole equipment. In this way, the forces detected by the sensor assembly passing through the sections of the casing accurately mimic the forces that will be exerted on the proposed equipment 34.

In one or more embodiments, sensor assembly 30, through sensor 46, optionally operating in conjunction with one or more elements of assembly 30, is adapted to directly and electronically measure one or more forces that can be experienced by the anticipated downhole equipment. For example, sensor assembly 30 can be adapted to directly experience and measure bending force, tubular bending, axial stress, shear, pressure, and torsional strain experienced by sensor assembly 30 as it passes through the casing. As indicated above, these measured forces can be used to determine or predict the resulting stresses and forces exerted on downhole production equipment subsequently installed.

In one or more embodiments, assembly 30 may include other sensors, such as those adapted to detect or measure temperature or any other environmental characteristic relevant to the installation or operation of downhole equipment.

Accordingly, the mapping step of the present invention includes gathering data obtained by sensor assembly 30 (e.g. data from strain-gauge sensor 46). Additionally, the step of mapping includes gathering locational information relative to where data from the assembly 30 (e.g. strain gauge data) is obtained. For example, mapping step may include determining and gathering data on the depth of the assembly relative to the surface. This data can be obtained directly from assembly 30, where assembly 30 is adapted to gather and provide this data, or from conveyance system 50, which can be adapted to gather and provide this data. For example, the depth of assembly 30 can determined by the length of cable fed into the cased hole. Accordingly, the mapping of the casing represents an interior dimensional and force profile of the casing at predetermined locations or intervals throughout the length or a portion of the installed casing.

In one or more embodiments, the information obtained from sensor assembly 30 being routed through at least a portion of the casing (i.e. mapping information), either alone or together with existing information from previous failures of installed downhole equipment, may be used to assist in selecting optimal locations for the anticipated downhole equipment. In addition, the information (such as bending and stress measurements) can help to identify locations in the casing string that exceed predetermined force thresholds where additional electrical cable protection may be required to ensure that an electrical conduit installed between casing and production tubing is not damaged during installation or while operating the lift equipment.

Figure 3:
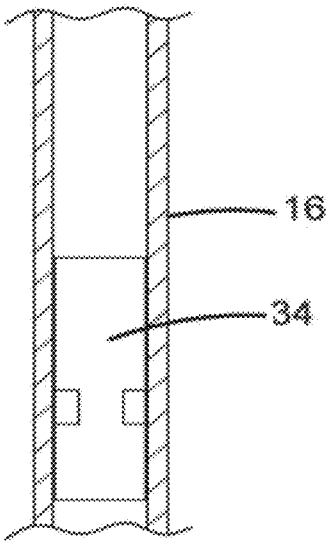
FIG. 3 is a schematic representation of a sensor assembly that represents downhole equipment according to the concepts of the present invention.

Accordingly, aspects of the invention include the step of installing downhole equipment based upon data and information derived from the mapping operation. With reference to FIG. 3, downhole equipment 34 is installed in casing 16 at a desired location where, based upon gathered data and information generated therefrom, the location is expected to provide a technologically useful production outcome. As those skilled in the art appreciate, successful outcomes depend on many factors including the longevity of the downhole equipment, which can be prolonged by proper placement of the equipment in a location of the well that does not suffer from deleterious tortuosity.

Practice of one or more embodiments of the invention is not limited by the type of downhole equipment installed. In one or more embodiments, the equipment includes production equipment such as artificial lift equipment. Artificial lift equipment many include, but is not limited to, electrical submersible pumps (ESPs), progressive cavity pumps (PCPs), rod pumps, gas lifts, plunger lifts, hydraulic lifts, foam lifts or any related piece of equipment installed within a section of casing.

Figure 5:
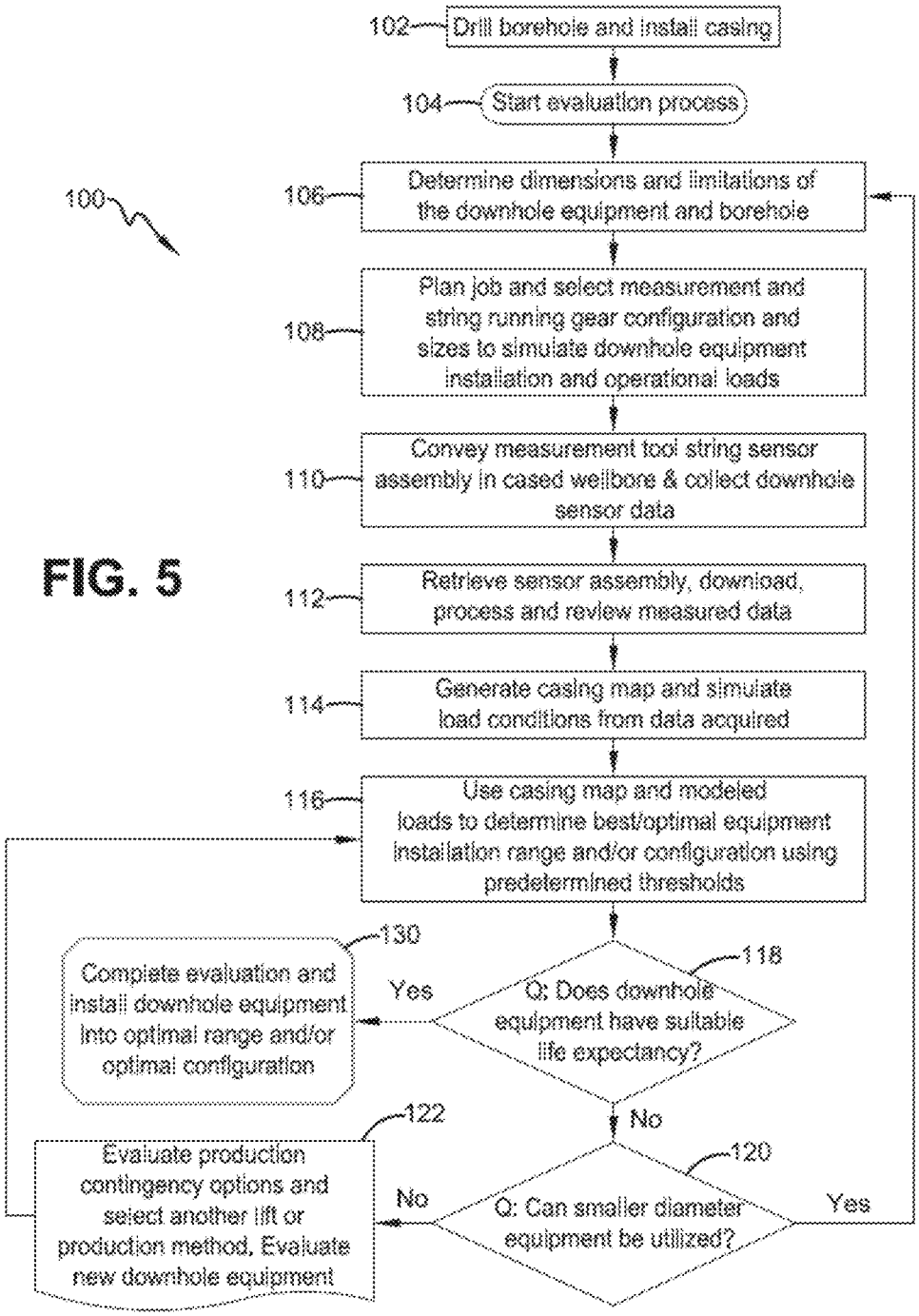
FIG. 5 is a flow chart of a methodology for implementing the optimization system according to the concepts of the present invention.

Referring now to FIG. 5, it can be seen that a method for determining an optimal installation of downhole equipment in a cased wellbore is designated generally by the numeral 100. Initially it is noted that step 102 provides for drilling a wellbore and installing a casing in selected sections of the wellbore. Skilled artisans will appreciate that the entire wellbore may be cased or that only selected sections of the wellbore may be cased. Positioning of the selected cased sections of the wellbore are dependent upon factors such as the geology of the wellbore and desired locations of wellbore equipment. Next, an evaluation process 104 is implemented which may include some or all of the following steps. At step 106, dimensions and limitations of the downhole equipment 19 to be installed are determined and general dimensions of the cased wellbore 16 are determined. For example, an educated estimation is made as to what size and configuration of downhole equipment will fit and operate in estimated locations of the cased wellbore and the sensor assembly is configured accordingly. To this end, the sensor assembly 18 is configured to represent a piece of downhole equipment to be installed in the casing. For example, configuration of the sensor assembly 18 may be done by shaping the body 30 to dimensionally represent the shape of the downhole equipment to be installed. Configuration may also include strategic placement of the strain gauge sensor within the shaped assembly to accurately represent the mechanical properties of the equipment and/or mimic the forces that will be applied to the equipment during use. Planning and selection of measurement and string running gear configurations that are sized to simulate the downhole equipment installation and operational loads that will likely be encountered by that equipment are implemented at step 108.

Next, at step 110, the sensor assembly is conveyed through the casing while measuring forces exerted on the sensor assembly. In particular, the sensor assembly 30, which incorporates the measurement tool string and the selected sensors, is conveyed in the cased wellbore 20 for the purpose of collecting downhole sensor data which represents the path of the cased wellbore. The sensor assembly may also detect changes in the casing's path, and any dimensional variations that result in extraneous forces on the sensor assembly. This step may be implemented by the conveyance system 50. After completion of the conveyance of the sensor assembly 30 at step 112, the sensor assembly can be retrieved, and the data from the sensor assembly can be retrieved and downloaded into an appropriately configured database whereupon the measured data is processed and reviewed. Alternatively, the data can be transmitted in real time while the sensor assembly is routed through the cased hole. At step 114, a casing map that identifies the path, changes in the path and the associated load conditions from the data acquired may be generated with appropriate software programs run by the controller 52, which may employ artificial intelligence and/or machine learning algorithms. This allows for the determination of locations throughout the casing which will likely exert acceptable amounts of force on the piece of downhole equipment to be installed. In the same context, it will also be determined during this step the locations which may exert unacceptable amounts of force on a piece of installed downhole equipment.

Accordingly, at step 116, the casing map and the associated load conditions are used to determine the best/optimal equipment installation location(s) and/or configuration using predetermined thresholds and other experiential guidance generated by the software programs. This analysis may also consider force thresholds for which added protection may be needed for electrical conduits. Upon completion of the ideal equipment and/or configuration, it will be determined at step 118 whether the downhole equipment will have a suitable life expectancy. If it is believed that the casing 16 will adversely affect operation of the equipment and no optimal location can be found for the equipment in the wellbore, then, at step 120, it is determined whether smaller equipment can be utilized. If this is the case, then the method returns to step 106 and steps 106-118 are repeated. For example, the sensor assembly can be adjusted or reconfigured (e.g. outer diameter or length) and the assembly can be rerouted to determine whether the forces experienced by the sensor exceed predetermined thresholds for any given region or location.

However, if at step 120 it is determined that smaller equipment cannot be utilized, then the technician will evaluate production contingency options and select another lift or production method for the evaluation of new downhole equipment. In other words, step 122 will return to step 116 to determine whether other downhole equipment can be implemented or not.

Returning to step 118, if it is determined that the downhole equipment to be installed has suitable life expectancy, then the method continues to step 130 where a complete installation of the downhole equipment into the optimal range and/or optimal configuration is completed.

Various modifications and alterations that do not depart from the scope and spirit of this invention will become apparent to those skilled in the art. This invention is not to be duly limited to the illustrative embodiments set forth herein.

What is claimed is:

1. A method for installing lift equipment within a cased wellbore, the method comprising:

(i) providing a first sensor assembly adapted to measure forces encountered while the first sensor assembly is routed through a cased wellbore, where the first sensor assembly is configured to represent the general geometry of lift equipment that is desired to be installed in the cased wellbore, and where the first sensor assembly is characterized by a size;

(ii) routing the first sensor assembly through at least a portion of the wellbore, where the at least a portion of the wellbore includes a location where installation of the lift equipment is desired;

(iii) measuring and logging forces experienced by the first sensor assembly during said routing the first sensor assembly through at least a portion of the wellbore;

(iv) providing a second sensor assembly adapted to measure forces encountered while the second sensor assembly is routed through a cased wellbore, where the second sensor assembly is configured to represent the general geometry of lift equipment that is desired to be installed in the cased wellbore, where the second sensor assembly is characterized by a size, and where the size of the first sensor assembly is different than the size of the second sensor assembly;

(v) routing the second sensor assembly through at least a portion of the wellbore, where the at least a portion of the wellbore includes a location where installation of the lift equipment is desired;

(vi) measuring and logging forces experienced by the second sensor assembly during said routing the second sensor assembly through at least a portion of the wellbore;

(vii) comparing data obtained from said measuring and logging forces experienced by the first sensor assembly relative to data obtained from said measuring and logging forces experienced by the second sensor assembly, and relative to predetermined force thresholds for desired lift equipment to thereby provide comparison information;

(viii) selecting lift equipment having a desired size and selecting a location for installing the lift equipment within the cased wellbore based upon the comparison information;

(ix) providing lift equipment of the desired size; and (x) installing the lift equipment;

where the first and second sensor assemblies each include, respectively, wheels and a sensor, where each assembly is adapted to have the wheels contact the cased wellbore while being routed therethrough and transfer forces experienced by the wheels when contacting the cased wellbore to the sensor.

2. The method of claim 1, further comprising the step of re-configuring the first sensor assembly to alter the size thereof and thereby provide the second sensor assembly.

3. The method of claim 1, where the second sensor assembly is a reconfigured version of the first sensor assembly.

4. The method of claim 1, where the first and second sensor assemblies, respectively, operate autonomously during routing through at least a portion of the wellbore.

5. The method of claim 4, where the first and second sensor assemblies, respectively, are in communication with a processing unit.

6. The method of claim 1, where the first and second sensor assemblies, respectively, include a swivel carriage.

7. The method of claim 6, where the swivel carriage of the first and second sensor assemblies swivels 360° about the longitudinal axis of the respective sensor assemblies.

8. The method of claim 2, where the wheels are positioned to represent the diameter of the lift equipment, and where said re-configuring includes altering the diameter of the second sensor assembly relative to the first sensor assembly.

9. A method for determining where to locate downhole lift device in a cased wellbore and positioning the downhole equipment, the method comprising:

(i) providing a cased wellbore including one or more deviations;

(ii) providing a first sensor assembly that is configured to substantially represent the geometry of a first downhole lift device, where the first sensor assembly includes a carriage that swivels, a plurality of wheels, and a strain gauge, where the carriage is adapted to swivel 360 degrees about an axis of the sensor assembly, where the sensor assembly is adapted to traverse the cased wellbore and is configured to contact the cased wellbore at the one or more deviations in a manner that exerts a force on one or more of the plurality of wheels, and where the strain gauge is adapted to measure forces exerted by the cased wellbore at the one or more deviations on one or more of the plurality of wheels;

(iii) conveying the sensor assembly through at least a portion of the cased wellbore;

(iv) measuring, by using the strain gauge, a plurality of forces exerted on the plurality of wheels during traversal thereof through the one or more deviations of the cased wellbore;

(v) based upon data obtained from said step of measuring, providing a second sensor assembly that is configured to have different size than that of the first sensor assembly, where the second sensor assembly includes a carriage that swivels, a plurality of wheels, and a strain gauge, where the carriage is adapted to swivel 360 degrees about an axis of the second sensor assembly, where the second sensor assembly is adapted to traverse the cased wellbore and is configured to contact the cased wellbore at the one or more deviations in a manner that exerts a force on one or more of the plurality of wheels of the second sensor assembly, and where the strain gauge of the second sensor assembly is adapted to measure forces exerted by the cased wellbore at the one or more deviations on one or more of the plurality of wheels of the second sensor assembly;

(vi) conveying the second sensor assembly through at least a portion of the cased wellbore;

(vii) measuring, by using the strain gauge, a plurality of forces exerted on the plurality of wheels of the second sensor assembly during traversal thereof through the one or more deviations of the cased wellbore;

(viii) determining from said plurality of forces obtained from said step of measuring the plurality of forces exerted on the plurality of wheels of the second sensor assembly an optimal location within the cased wellbore for positioning of a downhole lift device;

(ix) determining from said plurality of forces obtained from said step of measuring the plurality of forces exerted on the plurality of wheels of the second sensor assembly an appropriate downhole lift device for positioning within the optimal location within the cased wellbore; and (x) installing the downhole lift device in the optimal location within the cased wellbore.

10. The method according to claim 9, where the downhole lift device is selected from the group consisting of electrical submersible pumps (ESPs), progressive cavity pumps (PCPs), rod pumps, gas lifts, plunger lifts, hydraulic lifts, and foam lifts.

* * * * *